United States Patent [19]

Ruff

[11] Patent Number: 4,495,697

[45] Date of Patent: Jan. 29, 1985

[54] PLASTERBOARD TRIMMING TOOL

[76] Inventor: Stanley Ruff, 9 Arbor Dr., New Rochelle, N.Y. 10804

[21] Appl. No.: 413,267

[22] Filed: Aug. 31, 1982

[51] Int. Cl.[3] ..... B26B 29/00

[52] U.S. Cl. ..... 30/294; 30/287; 30/288; 145/20

[58] Field of Search ..... 30/287, 289, 290, 293, 30/294, 304, 169, 171, 288; 33/41 B, 41 F, 41 R, 44, 42, 174 R; 145/5 R, 5 A, 6, 8, 10, 20; 83/869, 879, 883, 885

[56] References Cited

U.S. PATENT DOCUMENTS

| | | | |
|---|---|---|---|
| 820,639 | 5/1906 | Gabrielson | 145/20 |
| 1,878,410 | 9/1932 | Lyon | 145/20 |
| 2,529,210 | 11/1950 | Butler | 33/44 X |
| 2,641,834 | 6/1953 | Bobrowski et al. | 30/287 |
| 3,791,014 | 2/1974 | Perna | 30/294 |

*Primary Examiner*—James M. Meister
*Assistant Examiner*—Douglas D. Watts
*Attorney, Agent, or Firm*—Kirschstein, Kirschstein, Ottinger & Israel

[57] ABSTRACT

A plasterboard trimming tool includes a main support element that consists of two parallel arms interconnected by a web and having lateral guiding surfaces which face one another and confine the marginal portion of the plasterboard between themselves in operation. A transverse guiding surface is provided on the web itself and/or an auxiliary support element which is selectively mountable on the web. A pair of cutting blades is mounted in respective holders at the same distance from the transverse guiding surface, the cutting blades having respective cutting edges which partially penetrate into the plasterboard to form continuous straight scoring cuts therein across the plasterboard from one another. The position of the auxiliary support element on the web can be reversed. The auxiliary support element has elongated sections of different thicknesses extending along the web, so that the distance of the scoring cuts from the edge face can be changed by reversing the position of the auxiliary support element. The auxiliary support element has a wedge-shaped leveling zone which levels the edge face of the plasterboard after the marginal portion of the same has been broken away along the scoring cuts. The auxiliary support element is of a flexible material and has an abutment section which is rigid with one of the elongated sections and prevents removal of the auxiliary support element from the web unless the one elongated section is deflected.

15 Claims, 9 Drawing Figures

PLASTERBOARD TRIMMING TOOL

BACKGROUND OF THE INVENTION

The present invention relates to plasterboard trimming tools in general, and more particularly to tools of this type which are capable of producing uninterrupted scoring cuts on the opposite sides of the plasterboard.

Plasterboard has been used in the building industry for many years if not decades and has gained widespread acceptance for its advantageous properties, such as excellent strength, easy handling and compatibility with other building materials. When using plasterboard, however, it is often necessary to cut the same down to size so as to properly fit the space available for its mounting on a support structure. The usual construction of plasterboard is that of a plate of gypsum or a similar substance which is covered, on both of its major surfaces, with layers of paper mass. Since gypsum is a rather brittle substance, the layers of paper mass not only protect the gypsum plate from being damaged during storage, transportation or handling, especially by the formation of indentations therein, but also impart a certain degree of resilience to the plasterboard so that the gypsum plate will not crack or disintegrate when subjected to impacts.

Because of the above-mentioned function of the paper or cardboard layers covering the gypsum plate, it has been realized a long time ago by people active in the building trade that it is not necessary to completely cut through the plasterboard when it is desired to remove a portion thereof, such as for the purpose of trimming the plasterboard to the desired size. Rather, it is sufficient to cut through the two covering layers, thereby destroying their resilient properties at the regions of the cuts, whereafter the portion of the plasterboard can be broken away from the remainder of the plasterboard by applying appropriately directed forces or torque thereto. Due to the brittleness of the material of the plate, a substantially clean break will be obtained in the plate in registry with the scoring cuts through the covering layers, without disintegration of either the broken-away portion, or of the remainder, of the plasterboard.

Based on this recognition, it is currently customary in the building trade to use an ordinary multi-purpose utility knife for producing the scoring cuts in the covering layers. This approach produces satisfactory results, provided that the two scoring lines or areas at the opposite sides of the plasterboard are in alignment with one another and exactly follow the desired courses, in most instances, straight lines. However, under the constraints of available time, many a construction worker will not take the pains to accurately measure and indicate the desired courses; rather, depending on his skill, the construction worker will resort to estimating the proper location of the scoring areas and to producing the scoring cuts without following a straightedge or a similar implement. The frequent result of this intended time-saving operation is a jagged edge face of the plasterboard, or the need for resorting to an additional levelling operation in which considerable amounts of excessive material are to be removed from the marginal portion of the plasterboard.

To remedy this situation, there has already been proposed a trimming tool including a tool holder carrying, in an opposite relation, a pair of rotatably mounted scoring discs provided at their peripheries with a plurality of spaced cutting teeth with externally facing cutting edges. During the operation of this trimming tool, the marginal portion of the plasterboard is received between the scoring discs and, during the movement of the trimming tool along the marginal portion of the plasterboard, the scoring discs are caused to rotate due to the engagement of the cutting teeth with the plasterboard, which causes the cutting teeth to penetrate into the plasterboard in the succession of their locations on the peripheries of the scoring discs. Since the cutting teeth, as mentioned before, are spaced from one another, in the circumferential directions of the respective scoring discs, they will produce interrupted scoring cuts on the opposite major surfaces of the plasterboard. Then, when it comes to breaking the marginal portion of the plasterboard away from the remainder of the plasterboard, the webs remaining between the individual cut areas will interfere with the breaking operation so that, once more, the edge face will be jagged. This, of course, is very disadvantageous.

SUMMARY OF THE INVENTION

Accordingly, it is a general object of the present invention to avoid the disadvantages of the prior art.

More particularly, it is an object of the present invention to provide a plasterboard trimming tool which does not possess the disadvantages of the conventional tools of this type.

Still another object of the present invention is to so construct the tool of the type here under consideration as to be able to simultaneously score the plasterboard at two opposite major surfaces thereof along continuous straight courses aligned with one another across the plasterboard.

It is yet another object of the present invention to so design the trimming tool as to be able to choose the distance at which the scoring cuts are located from the edge face of the plasterboard.

An additional object of the present invention is to develop a plasterboard trimming tool capable of being used to perform all required trimming operations.

A concomitant object of the present invention is to devise a tool of the above type which is simple in construction, inexpensive to manufacture, easy to use, and reliable in operation nevertheless.

In pursuance of these objects and others which will become apparent hereafter, one feature of the present invention resides in a plasterboard trimming tool which comprises, in combination, a support including at least two arms and an interconnecting portion connecting the arms and keeeping them apart; means for guiding the support on a marginal portion of the plasterboard in a position in which the support embraces the marginal portion, such guiding means including lateral guiding surfaces on the arms facing one another and spaced from each other by a distance substantially equal to the thickness of the plasterboard to engage the major surfaces of the latter in the aforementioned position, and a transverse guiding surface extending between the lateral guiding surfaces substantially normal thereto on the interconnecting portion to engage the edge face of the plasterboard in the aforementioned position; and means for simultaneously scoring the plasterboard at both of the major surfaces thereof in continuous straight cuts parallel to and spaced a predetermined distance from the edge surface of the plasterboard during the movement of the support in the aformentioned position along the marginal portion of the plasterboard, such scoring means including at least a pair of cutting blades each having at least one cutting edge, and at least a pair of holders each arranged on one of the arms of the support and operative for holding the associated cutting blade in at least one cutting position relative to the respective arm in which the cutting blade projects beyond the associated lateral guiding surface into the space between the lateral guiding surfaces at the predetermined distance from the transverse guiding surface, and in which the cutting edge of the cutting blade faces in the direction of movement of the support along the marginal portion of the plasterboard.

The advantage of the construction described so far is that, due to the mounting of the two cutting blades on a common support, that is, on two interconnected arms of such a common support which confine the marginal portion of the plasterboard between themselves, the scoring cuts are simultaneously provided at both of the major surfaces of the plasterboard and, due to the equal spacing of the two cutting blades from the transverse guiding surface which guides the support on the edge face of the plasterboard, at the same predetermined distance from and along straight lines parallel to the edge face. This is particularly true when, in accordance with a currently preferred aspect of the present invention, the holders are aligned with one another across the aforementioned space and thus, in use, across the plasterboard. Under these circumstances, the forces acting on the support during the use thereof are substantially symmetrical, so that there is no danger of edging or jamming of the support on the marginal portion of the plasterboard.

Advantageously, the arms have substantially plate-shaped configurations. This not only results in a low consumption of material for the support and easy manufacture of the latter, but also facilitates the storage and transportation of the trimming tool, especially since such a tool can easily be accommodated in a pocket of an overall or a similar garment used by the construction worker.

Advantageously, the holders for the cutting blades are so constructed that the cutting blades extend beyond the respective lateral guiding surfaces to less than a half of the thickness of the plasterboard when mounted in the holders, and most advantageously only to a distance slightly exceeding the thickness of the layer of paper material provided on the respective major surface of the plasterboard. It is further advantageous when the holders for the cutting blades are so constructed that the cutting blades extend substantially normal to the lateral guiding surfaces when mounted in the holders. This results in a situation where the entire break between the portion of the plasterboard to be removed from the remainder of the plasterboard by breaking the portion away is substantially planar.

It is particularly advantageous when each of the holders includes two holding members which are detachably connected to one another but which can be separated to gain access to the respective cutting blade, for instance, for reorientation or replacement purposes, these holding members, however, confining the respective cutting blade between themselves in the cutting position of the cutting blade and when connected to one another.

According to a further concept of the present invention, there is further provided means for selectively changing the predetermined distance. This expedient is advantageous and sometimes necessary in order to cut down on the time required to trim the plasterboard to the required size. Advantageously, this expedient is achieved, in accordance with the present invention, in that the interconnecting portion of the support is so constructed as to include a web rigid with the arms and constituting a main support element therewith, in which case the changing means includes an auxiliary support element constituting a part of the interconnecting portion and being removably mounted on the web, this auxiliary support element having two elongated sections each extending along the web in a mounted position of the auxiliary support element on the web and having a surface facing away from and spaced a different distance from the web to selectively serve as the transverse guiding surface when the respective section is received in the space between the arms and thus to change the predetermined distance on reversal of the position of the auxiliary support element on the web.

Advantageously, the changing means further includes at least one elongated shim of a predetermined thickness, and means for detachably connecting the shim at least to one of the sections of the auxiliary support element to add the thickness of the shim to the thickness of such section and thus to change the predetermined distance by the subtraction of its thickness therefrom. The connecting means advantageously includes cooperating snap-action male and female formations on the shim and on the one section. A particularly advantageous construction of the connecting means is obtained when the formations include at least two ball-shaped male formations on the shim, and at least two socket-shaped formations configurated to receive the male formations on the one section of the auxiliary support element.

According to an additional facet of the present invention, the plate-shaped arms extend beyond the web to give the main support element a substantially H-shaped cross section. Advantageously, these extensions are so dimensioned as to extend beyond the auxiliary support element in either of the mounted positions of the latter on the web, to define a guiding channel with the respective section of the auxiliary support element then received between the two extensions. This construction is particularly advantageous when at least one of the sections of the auxiliary support element has a leveling zone tapering to an edge situated in the plane of the aforementioned surface of this section, this leveling zone being arranged at the leading end of the respective section, as considered in the direction of movement of the support along the marginal portion of the plaster board, with the marginal portion of the plasterboard being received in the guiding channel. Then, the leveling zone will remove all bumps and irregularities resulting from the breaking operation, for instance, due to inclusions in or density variations of the material of the plasterboard and especially the gypsum central portion thereof.

A particularly simple and advantageous construction of the auxiliary support element is obtained when the latter is made of a resilient material and includes, in addition to the aforementioned elongated sections, a connecting section which connects the elongated sections and keeps the same in juxtaposition with the web in either one of the mounted positions of the auxiliary support element on the web. Then, it is further advantageous when the auxiliary support element also includes an abutment section rigid with one of the elongated sections and situated at the end thereof which is remote from the connecting section, the abutment section extending into the path of movement of the web relative to the auxiliary support element during the removal of the latter from the former, so that such removal can only be effected upon deflection of the one elongated section to an extent sufficient to remove the abutment section out of the aforementioned path. In this manner, the auxiliary support element is securely mounted on the web and prevented from accidentally slipping off the latter.

The novel features which are considered as characteristic of the invention are set forth in particular in the appended claims. The improved trimming tool itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
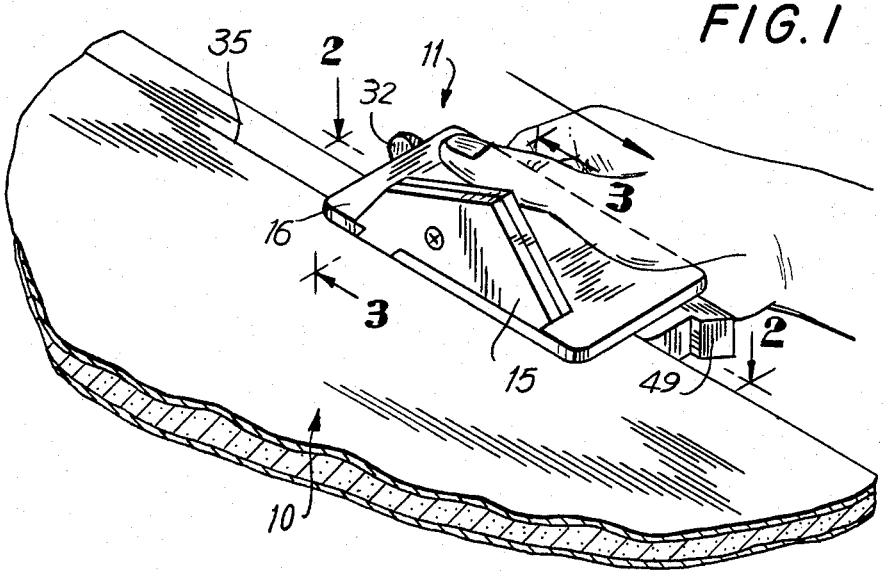
FIG. 1 is a perspective view of the trimming tool according to the invention as used to score a plasterboard.

Referring now to the drawing in detail, and first to FIG. 1 thereof, it may be seen that the reference numeral 10 has been used to identify a plasterboard which is to be trimmed by the removal of a marginal portion, or a plurality of marginal portions, therefrom. The trimming operation is accomplished by means of a trimming tool which is generally identified in the drawing by the reference numeral 11 and which is moved along the marginal portion to be removed during the trimming operation.

Figure 2:
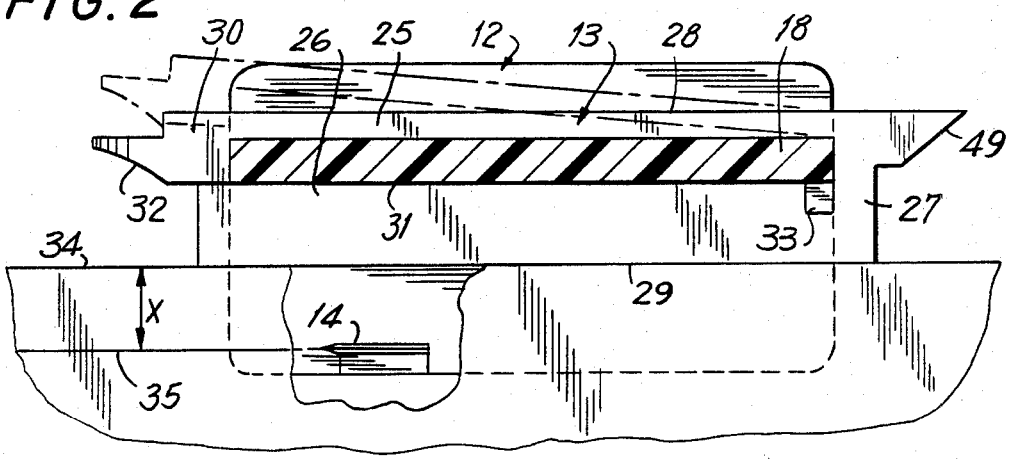
FIG. 2 is a partially sectioned side elevational view of the trimming tool of FIG. 1 in one of its cutting positions, taken on line 2—2 of FIG. 1.
Figure 3:
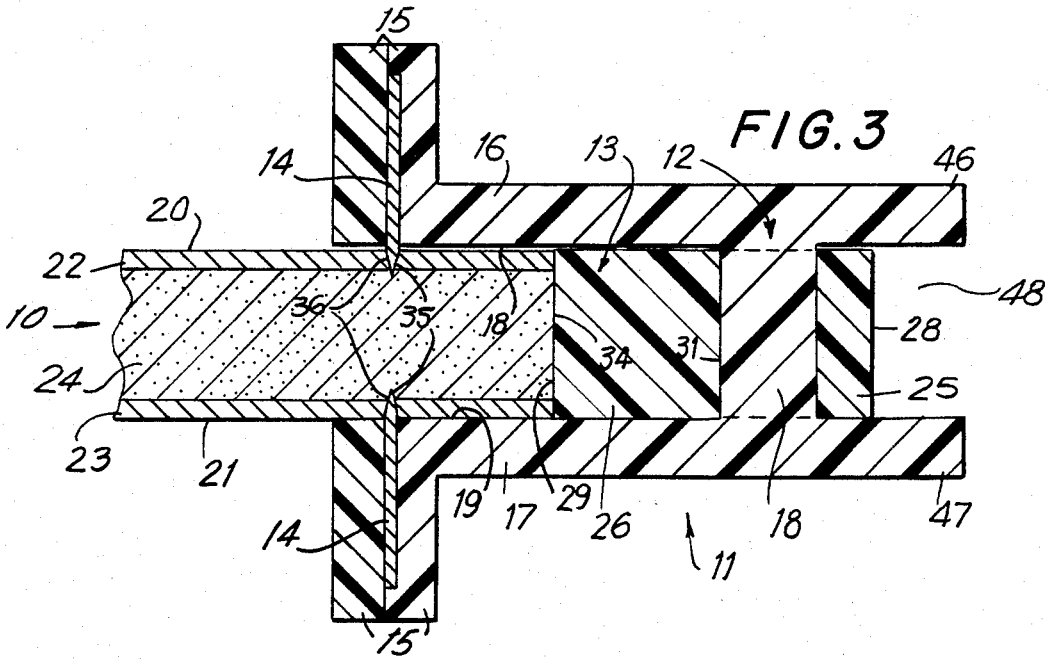
FIG. 3 is a cross-sectional view of the trimming tool in its cutting position, taken in line 3—3 of FIG. 1.

The basic construction of the trimming tool 11 and its operation as a scoring tool will best be understood from a comparison of FIGS. 2 and 3, in which the trimming tool 11 is shown in its cutting position. The trimming tool 11 includes a main support element 12 and an auxiliary support element 13. The main support element 12 carries a pair of cutting blades 14, each arranged on one side of the plasterboard 10, as may best be seen in FIG. 3. The cutting blades 14 are held in respective holders 15 therefor, which will be described in more detail later.

The main support element 12 includes two arms 16 and 17 which extend substantially parallel to one another, being interconnected by a web 18. Each of the arms 16 and 17 carries one of the holders 15 and has an internally situated lateral guiding surface 18 and 19, respectively. The lateral guiding surfaces 18, 19 are spaced from one another by a distance substantially corresponding to the thickness of the plasterboard 10, that is, to the distance between major surfaces 20 and 21 of the latter. The major surfaces 20 and 21 are provided on externally applied layers 22 and 23 of the plasterboard 10, these layers 22 and 23 being secured to the major surfaces of a plate-shaped central body 24 of the plasterboard 10. The central body 24 may be made of gypsum or a similar, usually brittle, material, while the layers 22 and 23 are made of a flexible material, usually paper material, such as paper sheets or cardboards. As may best be seen in FIG. 3, the holders 15 so hold the cutting blades 14 that the latter are arranged substantially normal to the lateral guiding surfaces 18 and 19, respectively, and penetrate into the plasterboard 10 to the extent slightly exceeding the thickness of the respective layers 22 and 23, but in any event to a much lesser extent than one-half the thickness of the plasterboard 10.

As depicted in FIG. 2, the auxiliary support element 13 includes two elongated sections 25 and 26 which are juxtaposed with the web 18 and are connected with one another by a connecting section 27. The elongated sections 25 and 26 have different thicknesses, such as, for instance, $\frac{1}{4}''$ for the section 25 and $\frac{1}{2}''$ for the section 26. The elongated sections 25 and 26 have external surfaces 28 and 29 which may serve as transverse guiding surfaces, in a manner yet to be described.

The auxiliary support element 13 further includes an abutment section 30 which extends into the path of movement of the web 18 relative to the auxiliary support element 13 along the main plane of the web 18. The auxiliary support element 13 is made of a flexible material and the abutment section 30 thereof is rigid with the elongated section 25 and separate from the elongated section 26. Because of the flexibility of the material of the auxiliary support element 13, the elongated section 25, together with the abutment section 30, can be deflected into the position illustrated in phantom lines in FIG. 2. In this position, the abutment section 30 is so positioned relative to the web 18 as not to abut the same during relative movement between the auxiliary support element 13 and the web 18 along the main plane of the latter, so that the auxiliary support element 13 can be slipped off the web 18, thus exposing a transverse guiding surface 31 of the latter. To facilitate the deflection of the elongated section 25, the latter is provided with a handgrip portion 32 configurated for easy manipulation, and the elongated section 25 is weakened by a recess 33, to thereby increase the flexibility of the auxiliary support element 13 in the plane of deflection of the elongated section 25.

Referring again to FIG. 3, it may be seen therein that the external surface 29 of the elongated section 26 is in contact with the plasterboard 10 at an edge face 34 of the latter. Thus, in this position of the auxiliary support element 13 on the web 18, in which the auxiliary support element 13 and the web 18 together form an interconnecting portion of the trimming tool 11, the external surface 29 guides the trimming tool 11 on the edge face 34 of the plasterboard 10, while the marginal portion of the latter is confined between the lateral guiding surfaces 18 and 19 of the arms 16 and 17. In this manner, the trimming tool 11 is guided on the plasterboard 10 with freedom of movement solely along the marginal portion of the plasterboard 10, any movement normal to the cutting blades 14 being prevented by the cutting blades 14 themselves, the direction of application of external forces to the trimming tool 11, and the engagement of the transverse surface 29 with the edge face 34. As the trimming tool 11 progresses along the marginal portion of the plasterboard 10, the cutting blades 14 form continuous cuts 35 on both sides of the plasterboard 10, due to the cutting action of cutting edges 36 of the cutting blades 14.

The cutting edges 36 of the cutting blades 14 are spaced by a predetermined distance, for instance, 1", from the transverse guiding surface 31 of the web 18. Thus, in the absence of the auxiliary support element 13 from the web 18, the transverse guiding surface 31 of the latter engages the edge face 34 of the plasterboard, and a distance x (see FIG. 2) separating the respective cut 35 from the edge face 34 equals the predetermined distance on each of the major surfaces of the plasterboard 10. However, when the auxiliary support element 13 is mounted on the web 18, in the position illustrated in FIGS. 2 and 3, this distance x is smaller by the thickness of the elongated portion 26. Using the exemplary dimensions given above, the distance x is thus $\frac{1}{2}$" under such conditions.

Figure 4:
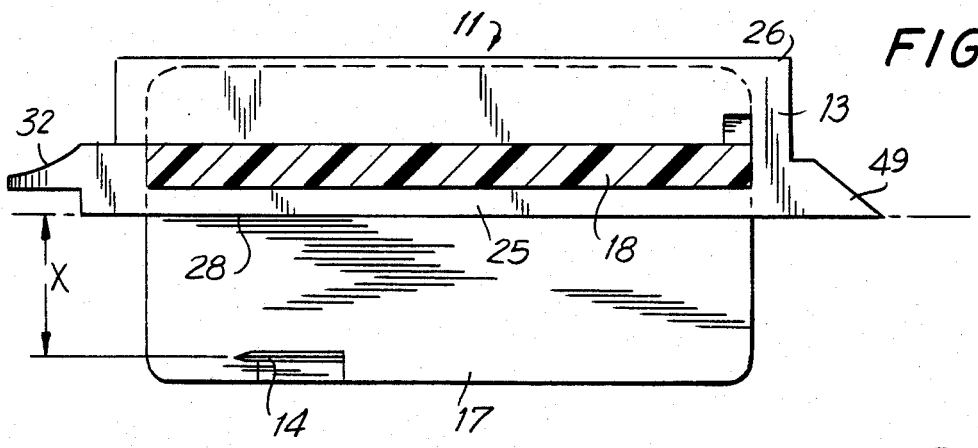
FIG. 4 is a view similar to that of FIG. 2 but in another cutting position of the trimming tool.

However, the position of the auxiliary support element 13 on the web 18 can also be reversed. This situation is shown in FIG. 4. Under these circumstances, the elongated portion 25 of the auxiliary support element 13 is accommodated between the arms 16 and 17, and the external surface 28 serves as the transverse guiding surface. Since the elongated section 25 is thinner than the elongated section 26, the distance x will now be between the two distances discussed above. Thus, for the dimensions mentioned above, the distance x will now be $\frac{3}{4}$".

Figure 5:
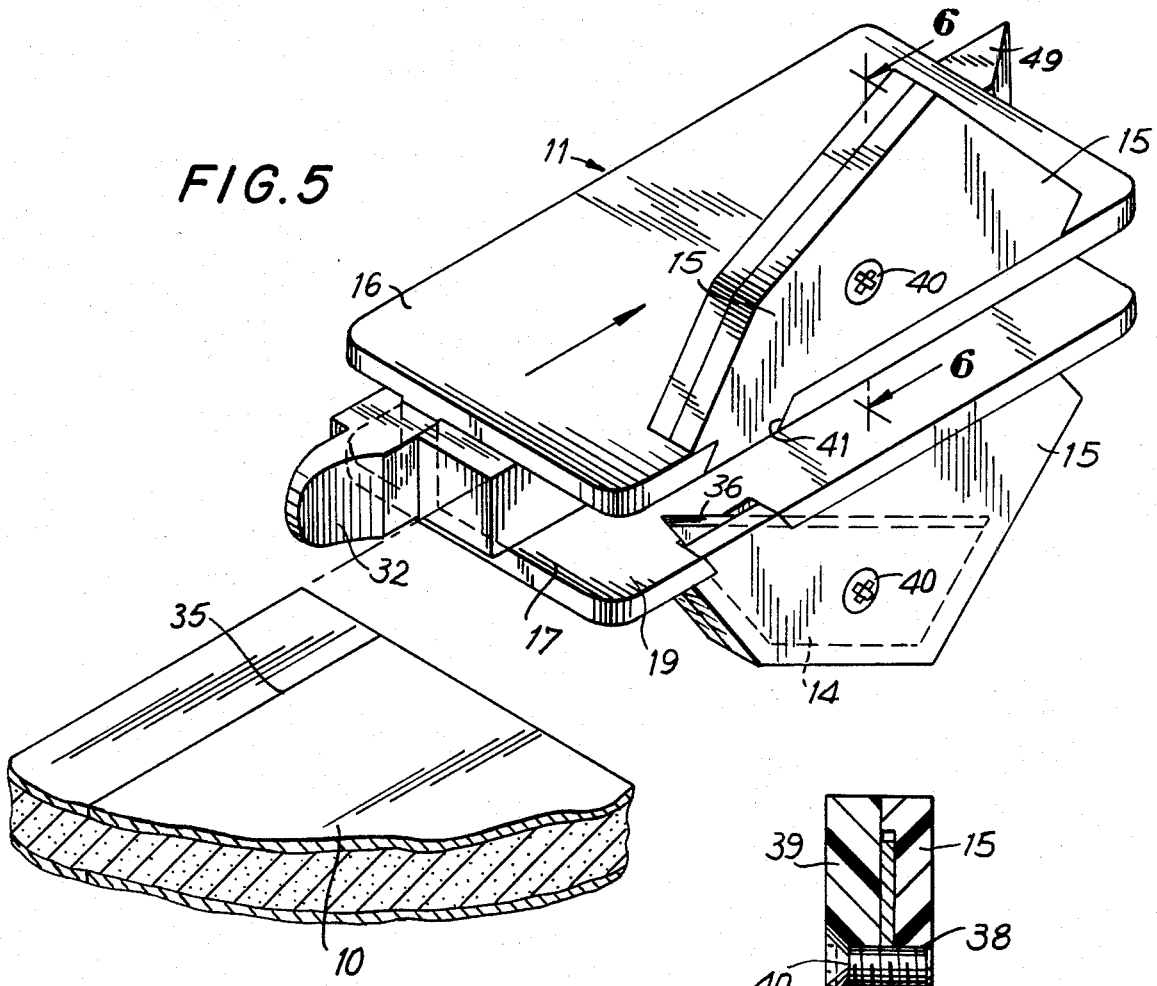
FIG. 5 is a perspective view of the trimming tool in juxtaposition with a previously scored plasterboard.

The construction of the holders 15 for the cutting blades 14 and the way in which the cutting blades 14 are mounted in the holders 15 are shown particularly in FIG. 5. As shown in connection with the holder 15 which is mounted on the arm 17, the cutting blade 14 is inclined with respect to the lateral guiding surface 19 at an angle which is so selected as to obtain best cutting results. Because of this inclination, the cutting edge 36 of the respective blade 14 gradually penetrates into the plasterboard 10 to form the respective cut 35 therein.

Figure 6:
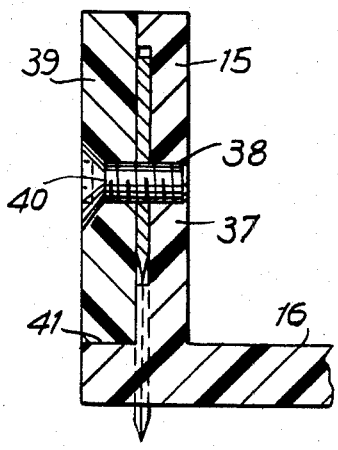
FIG. 6 is a sectional view through a cutting blade holder, taken on line 6—6 of FIG. 5.

As shown in detail in FIG. 6, the holder 15 mounted on the arm 16, and similarly also the other holder 15, includes a part 37 which is rigid with the arm 16 and is provided with a threaded bore 38, and another part 39 which is removably mounted on the part 37 by means of a screw 40. To prevent turning of the part 39 relative to the part 37 about the axis of the screw 40, the part 39 is received in a recess 41 bounded by the arm 16 and the part 37.

Figure 7:
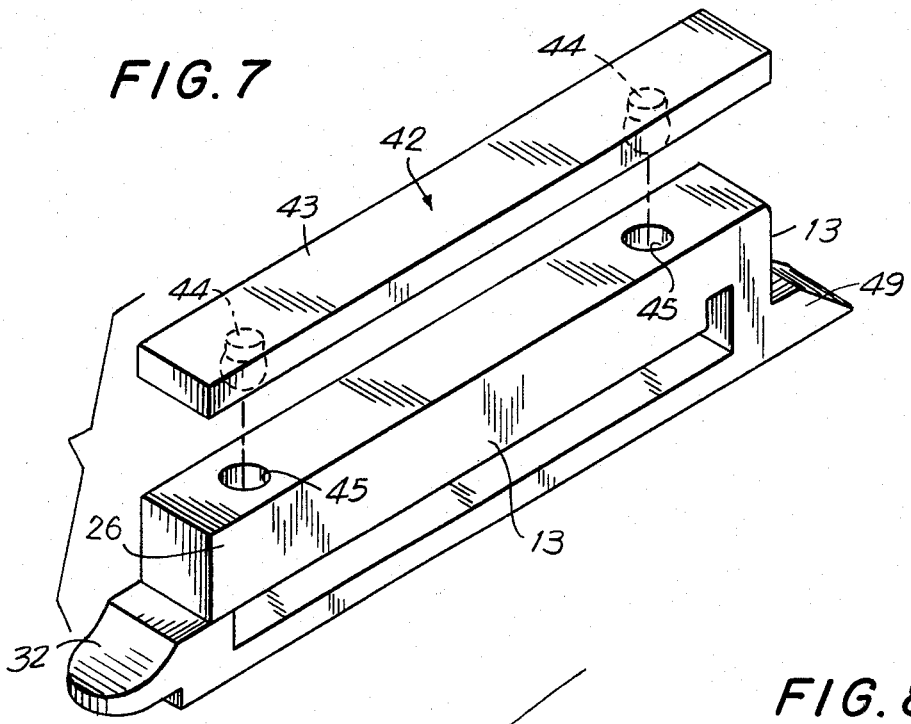
FIG. 7 is a perspective exploded view of an auxiliary support member as used in the trimming tool of FIGS. 1–6 in combination with a detachable shim.

As shown in FIG. 7, it is further possible to change the thickness of, for instance, the elongated section 26 by attaching a shim 42 thereto. If, for example, the shim 42 is $\frac{1}{4}$" thick, and given the above-mentioned dimensions, the distance x may thus be reduced to $\frac{1}{4}$". The shim 42 has an external surface 43 which serves as the transverse guiding surface under these circumstances. The shim 42 is attached to the section 26 by two substantially ball-shaped male formations 44 which are received, with snap action, in correspondingly configurated female formations or sockets 45 of the elongated section 26 of the auxiliary support element 13.

Figure 8:
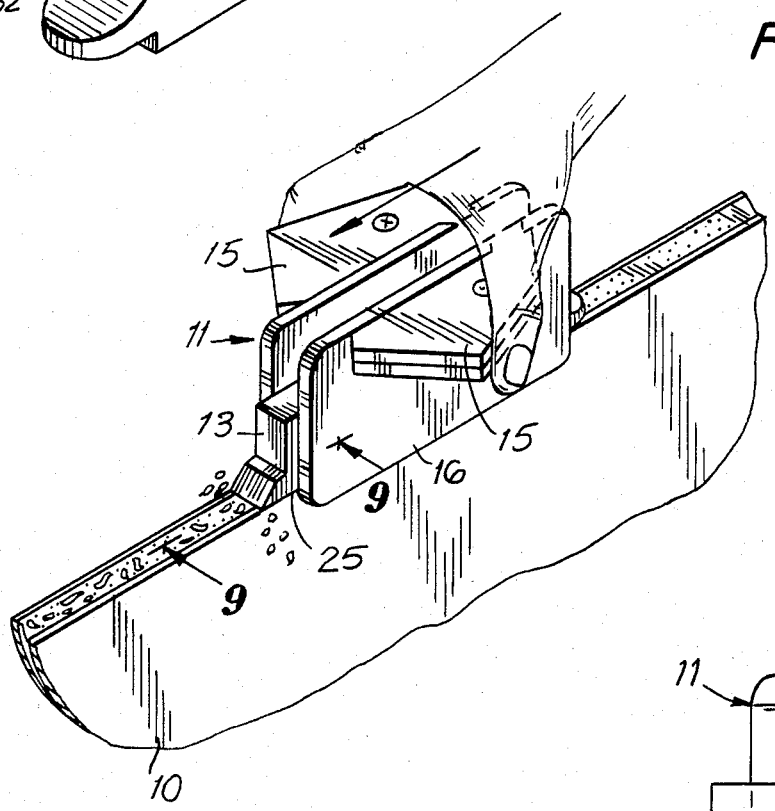
FIG. 8 is a perspective view of the trimming tool according to the invention in its leveling position with respect to the plasterboard.
Figure 9:
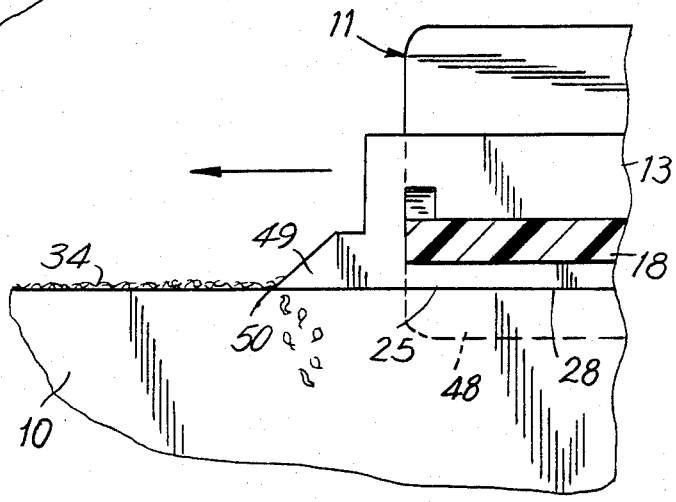
FIG. 9 is a fragmentary sectional view of the trimming tool in the position of FIG. 8, taken along the line 9—9 of FIG. 8.

Returning now for a moment to FIG. 3, it may be seen that the substantially plate-shaped arms 16 and 17 have respective extensions 46 and 47 which, in the position of the auxiliary support element 13 shown in FIGS. 3 and 8, embrace the elongated section 25 of the auxiliary support element 13 and extend beyond the same so as to form a guiding channel 48. As shown particularly in FIG. 9, the auxiliary support element 13 is provided, on the section 25 thereof, with a leveling zone 49 which has a substantially wedge-shaped configuration and includes a leveling edge 50 which is situated in the plane of the external surface 28 of the elongated section 25. Thus, when the trimming tool 11 is moved along the marginal portion of the plasterboard 10 in the position depicted in FIGS. 8 and 9, the leveling edge 50 will remove any excess material from the edge face 34 of the plasterboard 10. This leveling operation of the trimming tool 11 is especially advantageously used following the breaking-away of the marginal portion previously scored by the cutting blades 14 along the cuts 35, since smoothness of the new edge surface 34 cannot be assured, in most instances.

It may be seen from the above explanation that the trimming tool 11 of the present invention is capable of performing all the operations needed for trimming the plasterboard 10, that is, its scoring, and its leveling.

Another advantageous embodiment resides in removing the leveling zone 49 from the tool, and incorporating the leveling operation in a separate leveling tool. Preferably, a pair of support plate-shaped arms having lateral guiding surfaces facing one another is connected by an elongated interconnecting portion having a transverse guiding surface. The leveling zone is mounted on the support, and preferably on the interconnecting portion, and is operative, as described above, to engage the edge face of the plasterboard and to sever excessive material therefrom to form a clean, smooth edge face when the support is guided along the marginal portion of the plasterboard. Advantageously, two wedge-shaped leveling zones can be mounted at opposite end regions of the intermediate portion so as to permit leveling to be performed when the support is guided in either direction along the marginal portion of the plasterboard.

It will be understood that each of the elements described above, or two or more together, may also find a useful application in other types of arrangements differing from the type described above.

While the invention has been illustrated and described as embodied in a plasterboard trimming tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

I claim:

1. A plasterboard trimming tool, comprising:

(a) a support including (i) at least two arms and (ii) an interconnecting portion connecting said arms and keeping the same apart, said interconnecting portion including a web rigid with said arms and constituting a main support element therewith;

(b) means for guiding said support on a marginal portion of the plasterboard in a position in which said support embraces the marginal portion, including (i) lateral guiding surfaces on said arms facing one another and spaced from each other by a distance substantially equal to the thickness of the plasterboard to engage the major surfaces of the latter in said position, and (ii) a transverse guiding surface extending between said lateral guiding surfaces substantially normal thereto on said interconnecting portion to engage the edge face of the plasterboard in said position;

(c) means for simultaneously scoring the plasterboard at both of the major surfaces thereof in continuous straight cuts parallel to and spaced a predetermined distance from the edge surface of the plasterboard during the movement of said support in said position along the marginal portion of the plasterboard, including (i) at least a pair of cutting blades each having at least one cutting edge, and (ii) at least a pair of holders each arranged on one of said arms of said support and operative for holding the associated cutting blade in at least one cutting position relative to the respective arm in which said cutting blade projects beyond the associated lateral guiding surface into the space between said lateral guiding surfaces at said predetermined distance from said transverse guiding surface, and said cutting edge thereof faces in the direction of movement of said support along the marginal portion of the plasterboard; and (d) means for selectively changing said predetermined distance, including (i) an auxiliary support element constituting a part of said interconnecting portion and being removably mounted on said web, said auxiliary support element having two elongated sections each extending along said web in a mounted position of said auxiliary support member on said web and having a surface facing away from the latter and spaced a different distance therefrom to selectively serve as said transverse guiding surface when the respective section is received in the space between said arms and thus to change said predetermined distance on reversal of the position of said auxiliary support element.

2. The trimming tool as defined in claim 1, wherein said holders are aligned with one another across said space.

3. The trimming tool as defined in claim 1, wherein said arms have substantially plate-shaped configurations.

4. The trimming tool as defined in claim 1, wherein said holders are so constructed that said cutting blades extend beyond said lateral guiding surfaces to less than a half of the thickness of the plasterboard when mounted in said holders.

5. The trimming tool as defined in claim 1, wherein said holders are so constructed that said cutting blades extend substantially normal to said lateral guiding surfaces when mounted in said holders.

6. The trimming tool as defined in claim 1, wherein each of said holders includes two holding members detachably connected to one another for separation to gain access to the respective cutting blade and for confining the latter between themselves in said cutting position.

7. The trimming tool as defined in claim 1, wherein said changing means further includes at least one elongated shim of a predetermined thickness, and means for detachably connecting said shim at least to one of said sections to add the thickness thereof to the distance of the respective surface of said one section from said web and thus to change said predetermined distance by subtracting said thickness therefrom.

8. The trimming tool as defined in claim 7, wherein said detachably connecting means includes cooperating snap-type male and female formations on said shim and on said one section.

9. The trimming tool as defined in claim 8, wherein said formations include at least two ball-shaped male formations, and at least two socket-shaped female formations configurated to receive said male formations.

10. The trimming tool as defined in claim 1, wherein said arms have substantially plate-shaped extensions extending beyond said web to give said main support element a substantially H-shaped cross section.

11. The trimming tool as defined in claim 10, wherein said extensions extend beyond said auxiliary support element in either of the mounted positions of said auxiliary support element on said web, to define a guiding channel with the respective section of said auxiliary support element.

12. The trimming tool as defined in claim 11, wherein at least one of said sections of said auxiliary element has a leveling zone tapering to an edge situated in the plane of said surface of said one section to engage the edge surface of the plasterboard and sever excessive material therefrom when said main support element with said auxiliary support element mounted thereon in a leveling position is so guided along the marginal portion of the plasterboard that the latter is received in said guiding channel.

13. The trimming tool as defined in claim 1, wherein said auxiliary support element is of a resilient material and further includes a connecting section connecting said elongated sections and keeping the latter in juxtaposition with said web in either one of the mounted positions of said auxiliary support element on said web.

14. The trimming tool as defined in claim 13, wherein said auxiliary support element further includes an abutment section rigid with one of said elongated sections and situated at the end thereof remote from said connecting section, said abutment section extending into the path of movement of said web relative to said auxiliary support element during the removal of the latter from the former, so that such removal can be effected only upon deflection of said one elongated section to an extent sufficient to remove said abutment section out of said path.

15. A plasterboard leveling tool, comprising:

(a) a support including (i) at least two plate-shaped arms and (ii) an interconnecting portion fixedly connecting said arms and keeping the same apart;

(b) means for guiding said support in a stable manner on and along a marginal portion of the plasterboard in a position in which said support embraces the maginal portion, including (i) lateral planar guiding surfaces on said arms facing one another and spaced from each other by a fixed distance substantially equal to the thickness of the plasterboard to slidably engage the major surfaces of the latter over broad surface contact areas in said position, and (ii) a transverse planar guiding surface extending between said lateral guiding surfaces substantially normal thereto on said inteconnecting portion to slidably engage the edge face of the plasterboard over a broad surface contact area in said position, said lateral planar guiding surfaces extending all the way to said transverse planar guiding surface and bounding a three-sided guiding channel, all of whose sides slidably, respectively, engage the marginal portion and the edge face of the plasterboard and maintain the support in a stable manner on and along the marginal portion; and (c) leveling means on the support for engaging the edge face of the plasterboard, and for severing excessive material therefrom when said support is guided along the marginal portion of the plasterboard, including (i) a leveling zone having a tapered configuration which tapers to a leveling edge situated in the same plane as said transverse guiding surface and extending between said lateral guiding surfaces, said leveling zone being located at the leading end of the support at an open-air, unconfined region to engage the edge face of the plasterboard and form a clean, smooth, substantially planar surface along the edge face when said leveling edge is guided along the marginal portion of the plasterboard.

* * * * *